US011777241B2

(12) United States Patent
Kato

(10) Patent No.: US 11,777,241 B2
(45) Date of Patent: Oct. 3, 2023

(54) CONNECTOR, WIRING STRUCTURE AND INTER-BOARD CONNECTION METHOD

(71) Applicants: ACES Japan Co., Ltd., Tokyo (JP); ACES Electronics Co., Ltd., Taiwan (TW)

(72) Inventor: Nobukazu Kato, Tokyo (JP)

(73) Assignees: ACES Japan Co., Ltd., Tokyo (JP); ACES Electronics Co., Ltd., Taiwan (TW)

( * ) Notice: Subject to any disclaimer, the term of this patent is extended or adjusted under 35 U.S.C. 154(b) by 44 days.

(21) Appl. No.: 17/632,859

(22) PCT Filed: Jul. 31, 2020

(86) PCT No.: PCT/JP2020/029449
§ 371 (c)(1),
(2) Date: Feb. 4, 2022

(87) PCT Pub. No.: WO2021/024941
PCT Pub. Date: Feb. 11, 2021

(65) Prior Publication Data

US 2022/0320775 A1 Oct. 6, 2022

(30) Foreign Application Priority Data

Aug. 5, 2019 (JP) ..... 2019-143542

(51) Int. Cl.
*H01R 12/00* (2006.01)
*H01R 12/81* (2011.01)

(52) U.S. Cl.
CPC ..... *H01R 12/81* (2013.01); *H01R 2201/02* (2013.01); *H01R 2201/24* (2013.01)

(58) Field of Classification Search
CPC ..... H01R 12/81; H01R 13/65802; H01R 23/662; H01R 231/7005
See application file for complete search history.

(56) References Cited

U.S. PATENT DOCUMENTS

2009/0305544 A1 12/2009 Mizumura
2012/0231673 A1* 9/2012 Hayashi ..... H01R 24/62 439/675

(Continued)

FOREIGN PATENT DOCUMENTS

CN 104218405 A 12/2014
JP 07-008979 U 2/1995

(Continued)

OTHER PUBLICATIONS

International Search Report PCT/JP2020/029449 dated Sep. 29, 2020.

*Primary Examiner* — Phuong Chi Thi Nguyen
(74) *Attorney, Agent, or Firm* — Shih IP Law Group, PLLC

(57) ABSTRACT

Provided is a wiring structure with which a module board of one mobile communication apparatus can be connected to a circuit board of another mobile communication apparatus by using an optimal wiring material. The present invention is provided with: a main board 2; a first module board 8; a first connector that can be fitted to a coaxial cable connector and a connector mounted on a flexible printed board and that is mounted on the first module board; a second connector 10 fitted to the first connector; and wiring materials 6*a*, 6*b*, 14*a*-14*e* that are attached to the second connector and electrically connect the main board and the first module board.

18 Claims, 21 Drawing Sheets

(56) References Cited

U.S. PATENT DOCUMENTS

| | | | | |
|---|---|---|---|---|
| 2014/0370749 | A1* | 12/2014 | Kato | H01R 12/73 439/607.31 |
| 2015/0255911 | A1* | 9/2015 | Kato | H01R 13/5216 439/651 |
| 2019/0363467 | A1* | 11/2019 | Ko | H01R 13/5045 |
| 2022/0052468 | A1* | 2/2022 | Chang | H01R 12/716 |
| 2022/0094112 | A1* | 3/2022 | Kim | H01R 12/707 |
| 2022/0320766 | A1* | 10/2022 | Kim | H01R 12/716 |

FOREIGN PATENT DOCUMENTS

| | | | |
|---|---|---|---|
| JP | 2007-220535 | A | 8/2007 |
| JP | 2008-218064 | A | 9/2008 |
| JP | 2011-003300 | A | 1/2011 |
| JP | 2019-087462 | A | 6/2019 |
| WO | 2017053149 | A1 | 3/2017 |

* cited by examiner

CONNECTOR, WIRING STRUCTURE AND INTER-BOARD CONNECTION METHOD

TECHNICAL FIELD

The present invention relates to connectors and wiring structures mainly used for wiring in mobile communication apparatuses.

BACKGROUND ART

The next-generation (fifth generation, 5G) mobile communication system is being realized. Various coaxial cables and connectors for use in wiring in the mobile communication apparatuses are proposed (see Patent Literature (hereinafter, abbreviated as PTL) 1, for example).

CITATION LIST

Patent Literature

PTL 1
Japanese Patent Application Laid-Open No. 2008-218064

SUMMARY OF INVENTION

Technical Problem

It is expected for the next generation that not only smartphones but also notebook personal computers are used as mobile communication apparatuses. However, using an antenna module for smartphones for mobile communication apparatuses other than smartphones is desired. For this reason, a method for connecting the antenna module for smartphones to the circuit board of notebook personal computers is under consideration.

Furthermore, the next generation uses frequency bands higher than existing frequency bands. However, the higher frequency bands increase in radio-wave propagation loss. For this reason, antenna modules for the next generation are required to satisfy various strict conditions, such as antenna directivity. For the next-generation antenna modules with many restrictions, a wiring material for electrical connection can desirably be selected from a plurality of wiring materials. For example, if the distance between a circuit board and an antenna module is long, connecting them with a flexible printed board causes problems in cost and provision of sufficient wiring lines. When the distance between the circuit board and the antenna module is long, it is suitable to connect them with a coaxial cable. In contrast, if the distance between the circuit board and the antenna module is short, and the mobile communication apparatus main body is thin in thickness, it is suitable to connect them with a flexible printed board. Thus, it is desirable to allow for selecting an optimum transmission path between the circuit board and the next-generation antenna module so that the next-generation antenna modules with strict restrictions can be mounted to various kinds and shapes of mobile communication apparatuses.

An object of the present invention is to provide a connector and a wiring structure with which a module board of one mobile communication apparatus can be connected to a circuit board of another kind of mobile communication apparatus using an optimal wiring material.

Solution to Problem

A connector of the present invention is to be fitted to a mating connector mounted on a module board in a direction perpendicular to a surface of the module board, the mating connector including a first connection terminal and a second connection terminal each having a contact point exposed in a same direction and arranged in parallel, and a third connection terminal having a contact point exposed in a direction opposite to the same direction and arranged in parallel with the first connection terminal and the second connection terminal, the connector including: a first contact including, at one end, a core-wire connecting portion connected to a core wire of a coaxial cable and, at another end, a first contact portion that is to be connected to the first connection terminal of the mating connector when the connector is fitted to the mating connector; a second contact including, at one end, a shield connecting portion connected to an external shield of the coaxial cable and, at another end, a second contact portion that is to be connected to the second connection terminal of the mating connector when the connector is fitted to the mating connector, the second contact being to be connected to a gland of the module board via the second connection terminal of the mating connector; and a third contact including, at one end, an electrical-wire connecting portion connected to an electrical wire forming a circuit different from the coaxial cable and, at another end, a third contact portion that is to be connected to the third connection terminal of the mating connector when the connector is fitted to the mating connector.

In the connector of the present invention, the mating connector is fittable to a connector mounted on a flexible printed board.

Further, the connector of the present invention includes: a first shielding plate that is directly or indirectly connected to the external shield of the coaxial cable and that shields at least part between the first contact and the third contact, in which the first shielding plate is directly or indirectly connected to the gland of the module board.

Further, the connector of the present invention includes: a second shielding plate that is directly or indirectly connected to the external shield of the coaxial cable and that shields at least part of the first contact outside a direction in which the first contact and the third contact are arranged, in which the second shielding plate is directly or indirectly connected to the gland of the module board.

Further, the connector of the present invention includes: a third shielding plate that is directly or indirectly connected to the external shield of the coaxial cable and that shields at least part of the first contact on one side or opposite sides in a direction in which the first contact and the second contact are arranged, in which the third shielding plate is directly or indirectly connected to the gland of the module board.

Further, in the connector of the present invention, a direction in which the coaxial cable is inserted in the connector is a direction along a direction perpendicular to a fitting direction in which the connector is fitted to the mating connector.

Further, in the connector of the present invention, the coaxial cable is inserted closer to a fitting portion that is fitted to the mating connector than the electrical wire.

Further, in the connector of the present invention, the electrical wire is inserted closer to a fitting portion that is fitted to the mating connector than the coaxial cable.

Further, a wiring structure of the present invention includes: a main board; a first module board; a first connector fittable to a connector that is mounted on a coaxial cable connector and a flexible printed board, the first connector being mounted on or above the first module board; a second connector to be fitted to the first connector; and a wiring material attached to the second connector and electrically connecting the main board and the first module board to each other.

Further, the wiring structure of the present invention further includes: an electrical wire attached to the second connector and electrically connecting the main board and the first module board to each other, in which a first circuit formed by the wiring material and a second circuit formed by the electrical wire are different circuits.

Further, in the wiring structure of the present invention, the main board and the wiring material are electrically connected to each other via a second module board mounted on the main board.

Further, in the wiring structure of the present invention, the wiring material is disposed at a hinge of a portable electronic device that houses the wiring structure.

Further, in the wiring structure of the present invention, the wiring material is a coaxial cable or a flexible printed board.

Further, in the wiring structure of the present invention, the first module board is a communication module board for a smartphone.

Advantageous Effects of Invention

The present invention provides a connector and a wiring structure with which a circuit board of one mobile communication apparatus can be connected to a module board of another kind of mobile communication apparatus using an optimal wiring material.

DESCRIPTION OF EMBODIMENTS

Figure 1:
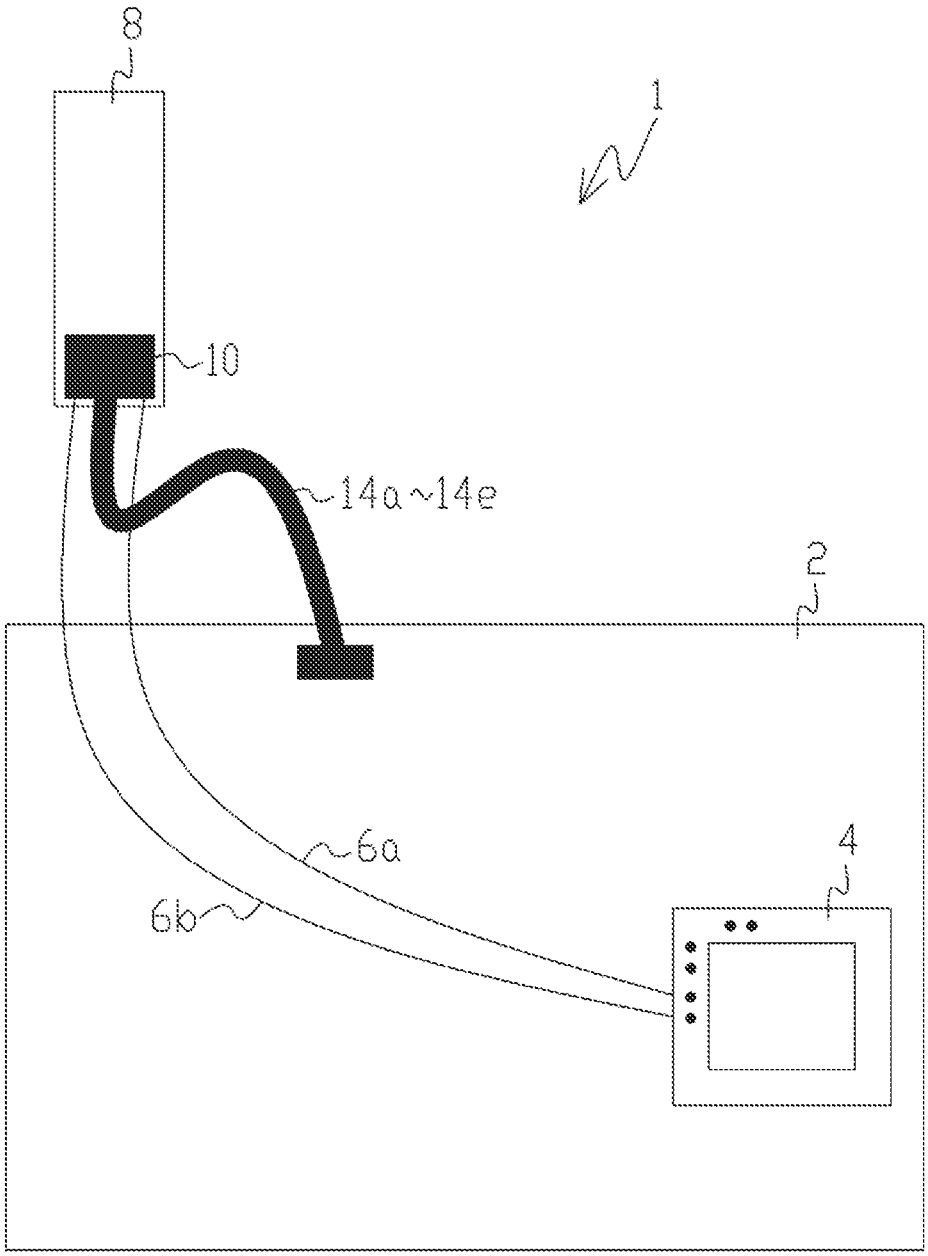
FIG. 1 is a diagram illustrating, in outline, a wiring structure for wiring between an antenna module board and a circuit board according to Embodiment 1.

A wiring structure and a plug connector included in the wiring structure according to Embodiment 1 of the present invention will be described hereinbelow with reference to the drawings. FIG. 1 is a diagram illustrating a wiring structure for wiring between an antenna module board for a smartphone and a circuit board of a personal computer according to Embodiment 1. Wiring structure 1 according to Embodiment 1 includes circuit board (main board) 2 of a mobile communication apparatus (a personal digital assistance or a portable electronic device) other than smartphones, for example, a personal computer (a notebook personal computer), antenna module board (first module board) 8, which is a communication module board for a smartphone, plug connector (a connector or a first connector) 10 mounted on the surface of antenna module board 8, receptacle connector 12 (a second connector, see FIG. 3), which is a mating connector fitted to plug connector 10, two coaxial cables 6*a* and 6*b*, which are wiring materials to be attached to receptacle connector 12, and five electrical wires 14*a* to 14*e*, which are wiring materials to be attached to receptacle connector 12.

Circuit board 2 of the personal computer is provided with expansion card (a Wi-Fi module board, a multicard connector, a multicard slot, for example, M.2) 4, which is a second module board. Expansion card 4 connects to two coaxial cables 6*a* and 6*b* and four coaxial cables (not shown). In other words, circuit board 2 and coaxial cables 6*a* and 6*b* are electrically connected via expansion card 4 mounted on circuit board 2. Antenna module board 8 for a smartphone and two antenna module boards (not shown) catch radio waves from different three directions. Coaxial cables 6*a* and 6*b* are connected to antenna module board 8 via plug connector 10 and receptacle connector 12 (see FIG. 3).

Likewise, two coaxial cables (not shown) and the remaining two coaxial cables (not shown) are each connected to the antenna module board (not shown) via the plug connector and the receptacle connector. In other words, coaxial cables 6*a* and 6*b* and the four coaxial cables (not shown) electrically connect the circuit board 2 and the individual antenna module boards via the plug connectors and the receptacle connectors.

Circuit board 2 is provided with five electrical wires 14*a* to 14*e*. Five electrical wires 14*a* to 14*e* are connected to antenna module board 8 via plug connector 10 and receptacle connector 12. In other words, electrical wires 14*a* to 14*e* electrically connect circuit board 2 and antenna module board 8 via plug connector 10 and receptacle connector 12.

A first circuit formed by coaxial cables 6*a* and 6*b* according to Embodiment 1 is a communication circuit, and a second circuit formed by electrical wires 14*a* to 14*e* is a power supply circuit or a control circuit. The first circuit and the second circuit are different circuits. The second circuit only has to be different from the first circuit and is not limited to the power supply circuit and the control circuit. Coaxial cables 6*a* and 6*b* and electrical wires 14*a* to 14*e* are disposed at a hinge of a personal computer housing wiring structure 1.

In Embodiment 1, antenna module board 8 is described as an example of a module board. The module board may be another module board other than antenna module board 8, for example, a camera module board or a liquid crystal display (LCD) module board.

Figure 2:
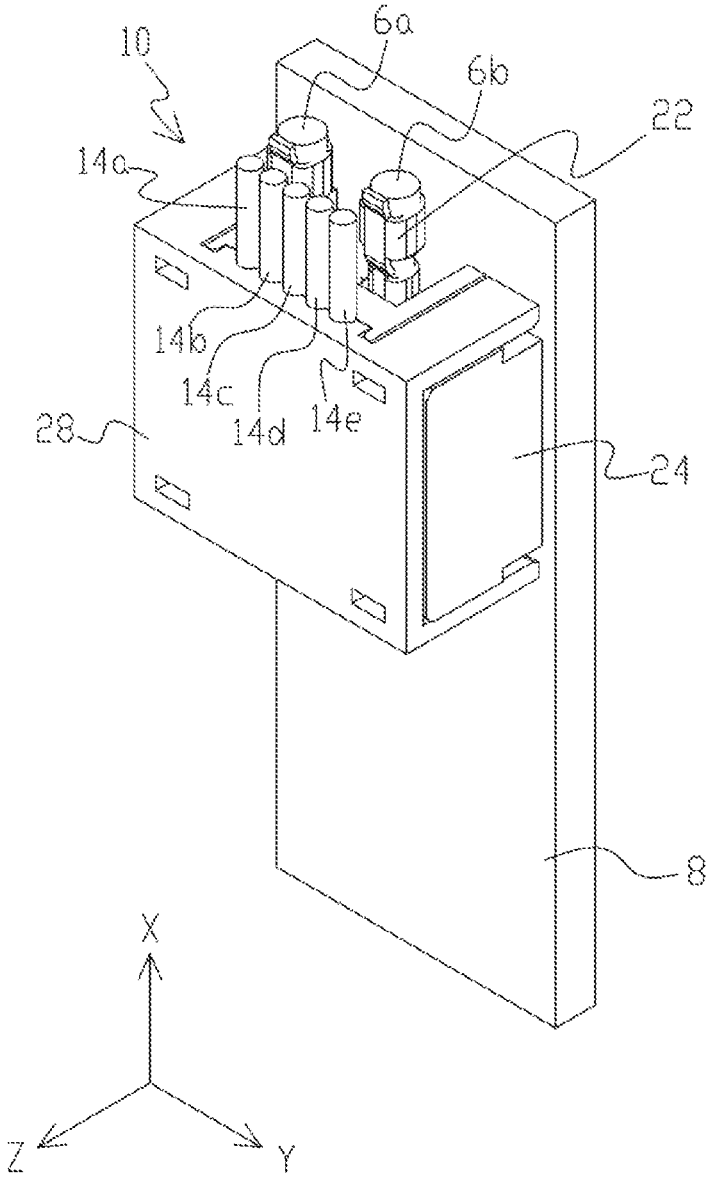
FIG. 2 is a perspective view of a receptacle connector mounted on an antenna module board and a plug connector fitted to the receptacle connector according to Embodiment 1.
Figure 3:
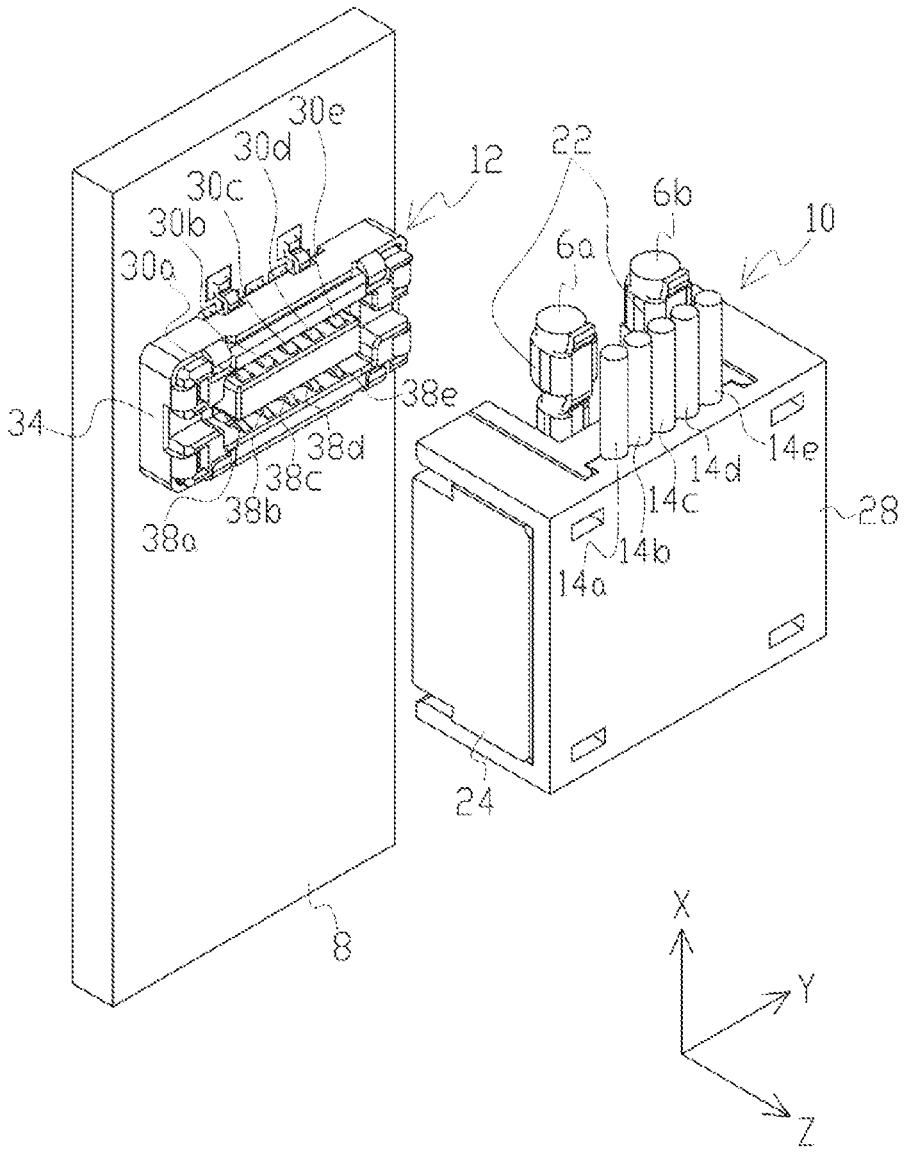
FIG. 3 is a perspective view of the receptacle connector and the plug connector according to Embodiment 1 illustrating the configuration thereof.
Figure 4:
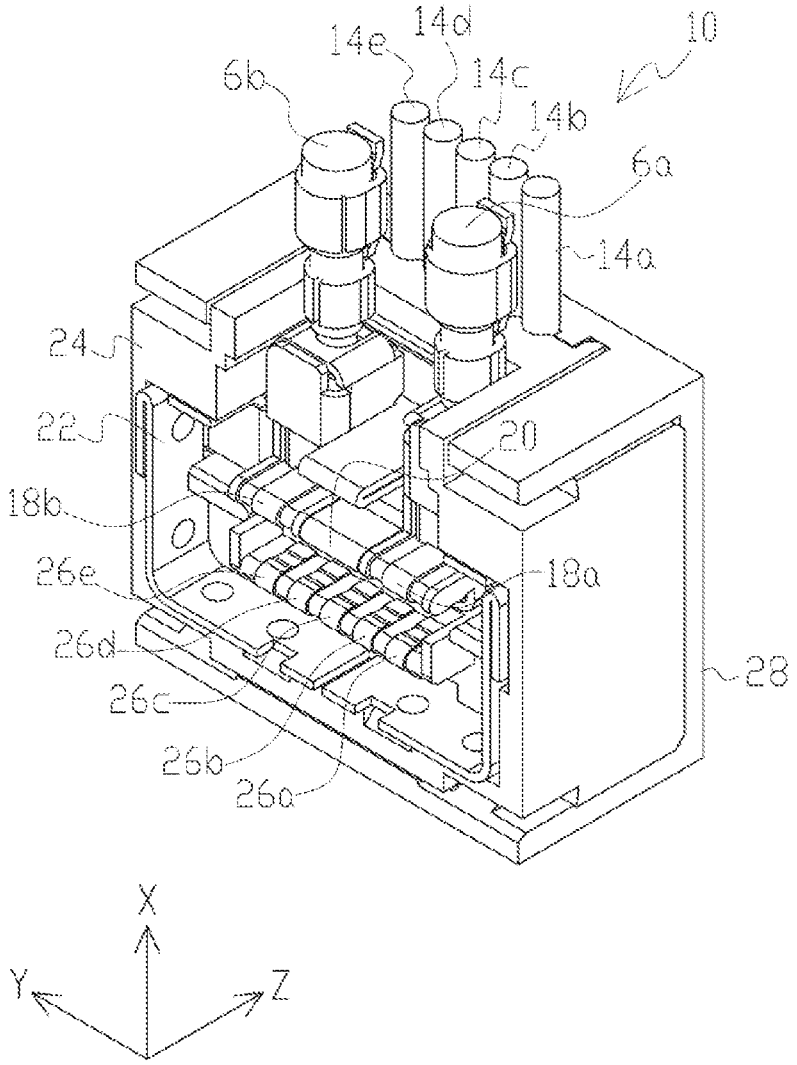
FIG. 4 is a perspective view of the plug connector according to Embodiment 1 illustrating the configuration thereof.
Figure 5:
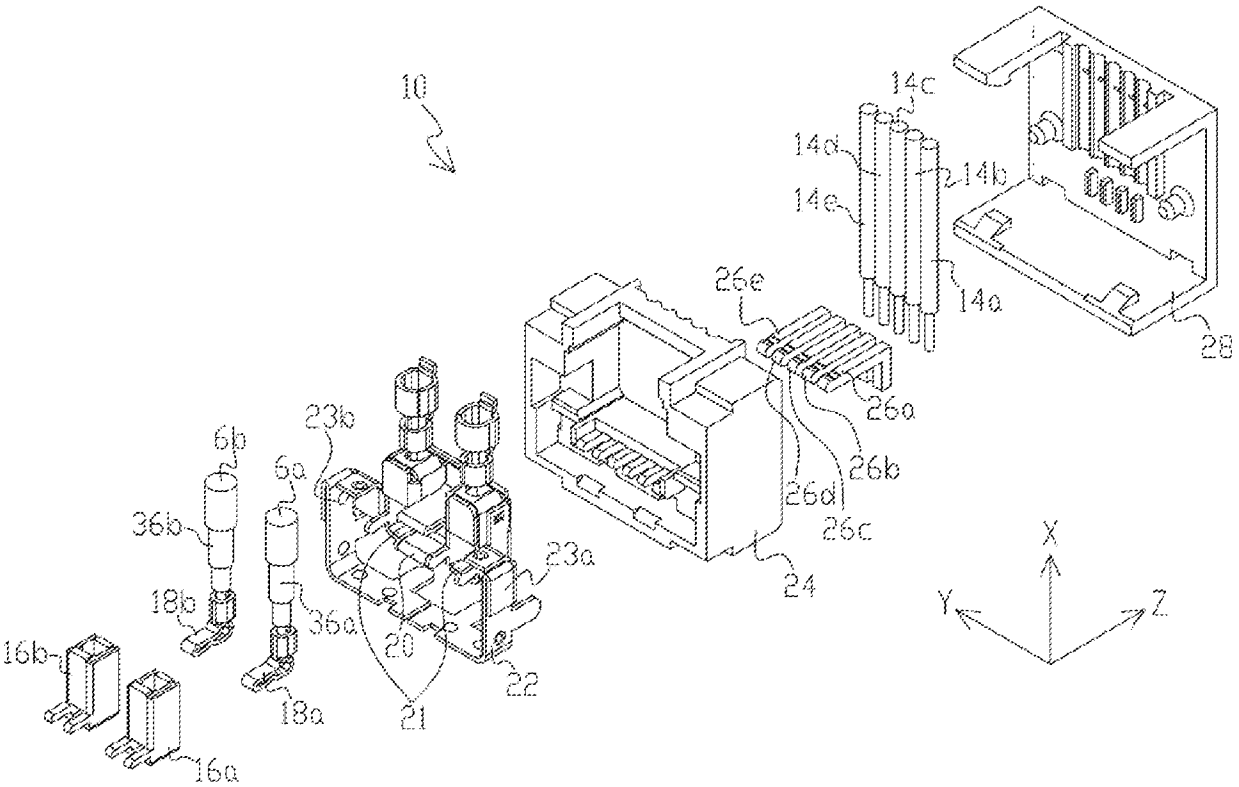
FIG. 5 is an exploded view of the plug connector according to Embodiment 1 illustrating the configuration thereof.
Figures 6A, 6B, 6C:
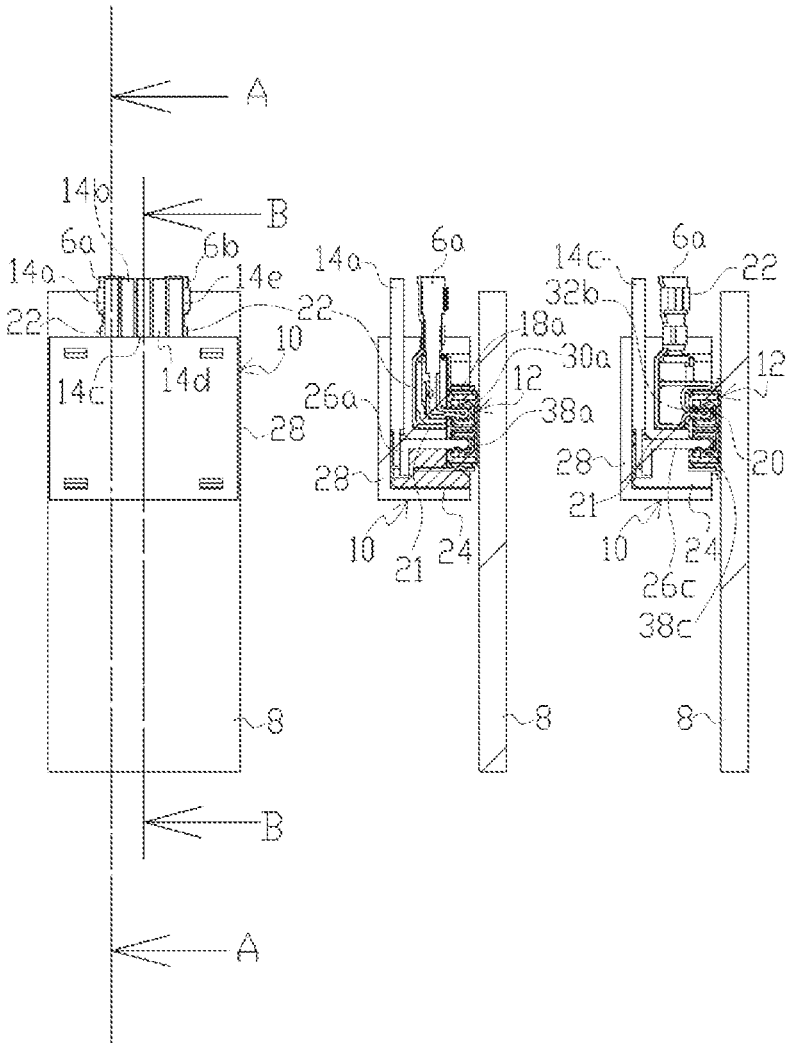
FIGS. 6A to 6C are diagrams illustrating a state in which the receptacle connector and the plug connector according to Embodiment 1 are fitted.

FIG. 2 is a perspective view of receptacle connector 12 and plug connector 10 in fitted state. FIG. 3 is a perspective view of receptacle connector 12 and plug connector 10 not fitted to each other. FIG. 4 is a perspective view of plug connector 10 illustrating the configuration thereof. FIG. 5 is an exploded view of plug connector 10 illustrating the configuration thereof. FIG. 6A is a front view of receptacle connector 12 and plug connector 10 in fitted state. FIG. 6B is a cross-sectional view taken along A-A of FIG. 6A. FIG. 6C is a cross-sectional view taken along line B-B of FIG. 6A. FIG. 2 to FIG. 6C illustrate only ends of coaxial cables 6*a* and 6*b* and electrical wires 14*a* to 14*e* for the convenience of description of the configuration of plug connector 10.

In the following description, the XYZ orthogonal coordinate system shown in FIG. 2 is set, and the positional relationship and so on of the components will be described with reference to the orthogonal coordinate system. The X-axis is set to the longitudinal direction of antenna module board 8, the Y-axis is set to the lateral direction of antenna module board 8, and the Z-axis is set to the direction perpendicular to the mounting surface on which receptacle connector 12 is mounted.

Receptacle connector 12 is a connector mounted on antenna module board 8 in advance and can be fitted to a connector (see FIGS. 9A to 9C) mounted on a coaxial cable connector, such as plug connector 10, and a connector mounted on a flexible printed board (FPC). In other words, antenna module board 8 is fitted with receptacle connector 12 that functions as a board-to-board connector to be fitted to a connector mounted on an FPC. The use of plug connector 10 allows antenna module board 8 used for a smartphone to be connected to circuit board 2 of a mobile communication apparatus, such as a personal computer, other than a smartphone without any change. In other words, identical antenna module board 8 can be used for a different application (a smartphone or a personal computer).

Plug connector 10 is fitted to receptacle connector 12 in the direction crossing (perpendicular to) the surface of antenna module board 8. Plug connector 10 includes two housings 16*a* and 16*b*, two first contacts 18*a* and 18*b*, gland fitting 22, housing 24, five third contacts 26*a* to 26*e*, and housing 28.

Housings 16*a* and 16*b* are insulators, such as resin. One first contact 18*a* is a conductor, such as metal, which is built in one housing 16*a*, and includes a core-wire connecting portion that is electrically connected to the core wire of coaxial cable 6*a* at one end (on the +Z direction side). At the other end (on the −Z direction side) of first contact 18*a*, a first contact portion that is electrically connected to mating contact 30*a* (a first connection terminal, see FIG. 3) of receptacle connector 12 when receptacle connector 12 and plug connector 10 are fitted.

The other first contact 18*b* is a conductor, such as metal, which is built in the other housing 16*b*, and includes a core-wire connecting portion that is electrically connected to the core wire of coaxial cable 6*b* at one end (+Z direction). At the other end (−Z direction) of first contact 18*b*, a first contact portion that is electrically connected to mating contact 30*e* (first connection terminal, see FIG. 3) of receptacle connector 12 when receptacle connector 12 and plug connector 10 are fitted.

Gland fitting 22 is a conductor, such as metal, and includes shield connecting portions that electrically connect to respective external shields 36*a* and 36*b* of coaxial cables 6*a* and 6*b* at one end (+Z direction) of gland fitting 22. Gland fitting 22 includes, at the other end (in the −Z direction), second contact portion 20 that is electrically connected to mating contacts 30*b* to 30*d* (second connection terminals, see FIG. 3) of receptacle connector 12 when receptacle connector 12 and plug connector 10 are fitted. In other words, gland fitting 22 includes the shield connecting portions and second contact portion 20 that function as second contacts and connects to the gland of antenna module board 8 via mating contacts 30*b* to 30*d*. When receptacle connector 12 and plug connector 10 are fitted, gland fitting 22 is electrically connected to shell 34 of receptacle connector 12. In other words, respective external shields 36*a* and 36*b* of coaxial cables 6*a* and 6*b* are connected to the gland of antenna module board 8 via gland fitting 22 and shell 34 of receptacle connector 12.

Gland fitting 22 includes shielding plates (first shielding plates) 21. Shielding plates 21 have a surface along a plane parallel to the Y-Z plane to shield at least part (part or the whole) between first contacts 18*a* and 18*b* and third contacts 26*a* to 26*e*. In other words, shielding plates 21 connect indirectly to external shields 36*a* and 36*b* of coaxial cables 6*a* and 6*b* via gland fitting 22 and connects to the gland of antenna module board 8 via gland fitting 22 and shell 34 of receptacle connector 12. This configuration can strengthen the gland. Gland fitting 22 is built in housing 24, which is an insulator, such as resin Gland fitting 22 includes shielding plates (third shielding plates) 23*a* and 23*b*. Shielding plates 23*a* and 23*b* each have a surface along a plane parallel to the Z-X plane. Shielding plate 23*a* shields at least part (part or the whole) of first contact 18*a* in the direction (−Y direction) in which first contacts 18*a* and 18*b* and second contact portion 20 (second contact) are arranged. Shielding plate 23*b* shields at least part (part or the whole) of second contact 18*b* in the direction (+Y direction) in which first contacts 18*a* and 18*b* and second contact portion 20 (second contact) are arranged. In other words, shielding plates 23*a* and 23*b* connect indirectly to external shields 36*a* and 36*b* of coaxial cables 6*a* and 6*b* via gland fitting 22 and connect to the gland of antenna module board 8 via gland fitting 22 and shell 34 of receptacle connector 12. This configuration can strengthen the gland.

Shielding plates 21, 23*a*, and 23*b* may be connected directly to external shields 36*a* and 36*b* or may be connected directly to the gland of antenna module board 8. It is second contact portion 20 (second contact) that functions as a shielding plate that shields at least part (part or the whole) of first contact 18*a* on the +Y direction side and a shielding plate that shields at least part (part or the whole) of first contact 18*b* on the −Y direction side.

First contacts 18*a* and 18*b* and second contact portion 20 (second contact) are arranged in parallel in the Y direction. Specifically, first contact 18*a*, second contact portion 20, first contact 18*b* are arranged in this order from the −Y direction. In other words, second contact portion 20 (second contact) is disposed between coaxial cable 6*a* (first contact 18*a*) and coaxial cable 6*b* (first contact 18*b*). This configuration can strengthen the gland. Mating contacts 30*a* to 30*e* of receptacle connector 12 have contact points exposed in the same direction (+X direction) and are disposed in parallel from the −Y direction side.

Third contacts 26*a* to 26*e* are conductors, such as metal, are built in housing 24, and each include, at one end, an electrical-wire connecting portion that electrically connects to corresponding one of electrical wires 14*a* to 14*e*. Third contacts 26*a* to 26*e* each include, at the other end, a third contact portion that is electrically connected to corresponding one of mating contacts 38*a* to 38*e* (third connection terminals, see FIG. 3) of receptacle connector 12 when receptacle connector 12 and plug connector 10 are fitted. Third contacts 26*a* to 26*e* are built in housing 24. Third contacts 26*a*, 26*b*, 26*c*, 26*d*, and 26*e* are arranged in this order from the −Y direction side. Likewise, mating contacts 38*a* to 38*e* of receptacle connector 12 each have a contact point exposed in the −X direction and area arranged in order from the −Y direction side.

Mating contacts 30*a* to 30*e* are arranged in parallel with mating contacts 38*a* to 38*e*, have the same shape, and are mounted on the surface of antenna module board 8. Mating contacts 38*a* to 38*e* have a line-symmetrically identical in shape to mating contacts 30*a* to 30*e* and are mounted on the surface of antenna module board 8. The portion of mating contact 30*a* that is to come into contact with first contact 18*a* has a spring shape. This portion pushes the contact portion of first contact 18*a* using the spring force to ensure connection to first contact 18*a*. Likewise, the portions of mating contacts 30*b* to 30*e* and 38*a* to 38*e* that are to come into contact with first contact 18*b*, second contact portion 20, and third contacts 26*a* to 26*e* have a spring shape. These portions push the contact portions of first contact 18*b*, second contact portion 20, and third contacts 26*a* to 26*e* using the spring force to ensure connection to first contact 18*b*, second contact portion 20, and third contacts 26*a* to 26*e*. In this embodiment, mating contacts 30*b* to 30*e* and 38*a* to 38*e* have a spring shape. Alternatively, the contact portions of first contacts 18*a* and 18*b*, second contact portion 20, and the contact portions of third contacts 26*a* to 26*e* may have a spring shape.

The array of first contacts 18*a* and 18*b* and second contact portion 20 and the array of third contacts 26*a* to 26*e* are disposed in parallel in the X direction. This allows for connecting to all signals necessary for antenna module board 8 only with plug connector 10. The contact portions of first contacts 18*a* and 18*b* that are to be connected to mating contacts 30*a* and 30*e*, second contact portion 20, and the contact portions of third contacts 26*a* to 26*e* to be connected to mating contacts 38*a* to 38*e* face each other. Housing 28 is a conductor, such as resin, which is fixed to housing 24, with third contacts 26*a* to 26*e* and electrical wires 14*a* to 14*e* disposed between the housing 28 and housing 24.

First contacts 18*a* and 18*b* are enclosed in all directions by shielding plates 21, 23*a*, and 23*b*, gland fitting 22, and second contact portion 20, which are indirectly connected to the gland of antenna module board 8. This configuration allows for appropriately transmitting high-speed signals with the impedance of first contacts 18*a* and 18*b* and the impedance of coaxial cables 6*a* and 6*b* matched.

The direction in which coaxial cables 6*a* and 6*b* and electrical wires 14*a* to 14*e* are inserted in plug connector 10 is the −X direction. This is a direction perpendicular to the fitting direction (Z direction) in which plug connector 10 and receptacle connector 12 are fitted or a direction along the perpendicular direction. Coaxial cables 6*a* and 6*b* are inserted closer to the fitting side on which plug connector 10 is fitted to receptacle connector 12 than the electrical wires 14*a* to 14*e*, in other words, adjacent to antenna module board 8 (−Z direction).

Embodiment 1 has been described using plug connector 10, which is a connector for electrical wires and coaxial cables (an electrical wire+coaxial cable complex connector) by way of example. Alternatively, a board-to-board connector (B-to-B connector), a board-to-board connector mounted on a flexible printed board (B-to-B on FPC), or a board-to-electrical-wire connector, other than plug connector 10, may be fitted to receptacle connector 12. In other words, for next-generation antenna modules with many restrictions, wiring materials for electrical connection are desirably selected from a plurality of wiring materials. In this embodiment, an optimum wiring material (transmission path) for circuit board 2 and antenna module board 8 can be selected so that antenna module board 8 can be mounted to various types and shapes of mobile communication apparatus.

Figure 7:
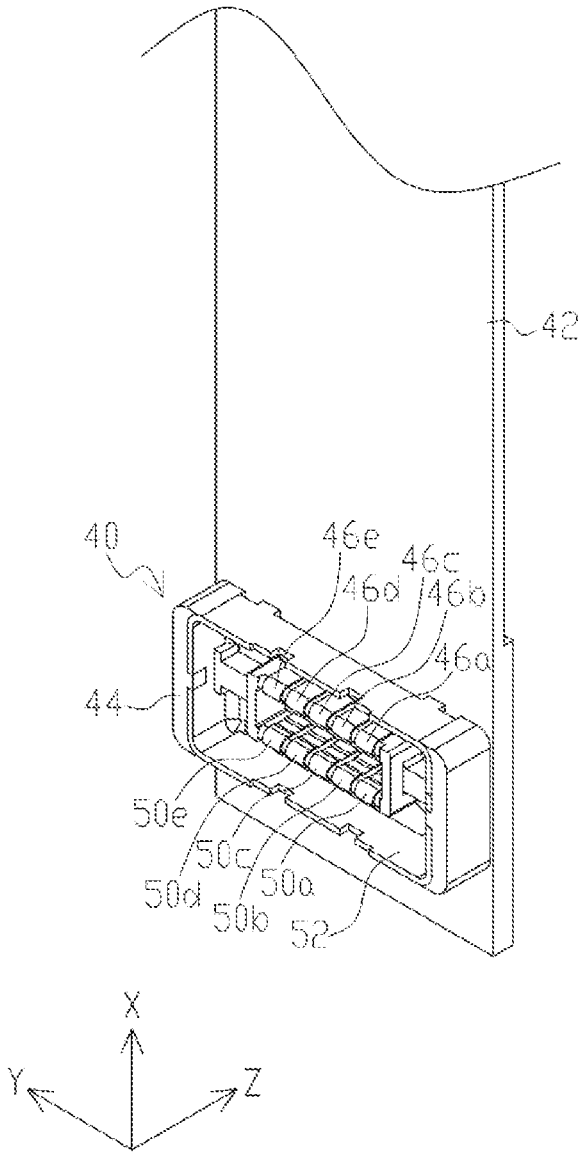
FIG. 7 is a perspective view of a plug connector according to another embodiment illustrating the configuration thereof.
Figure 8:
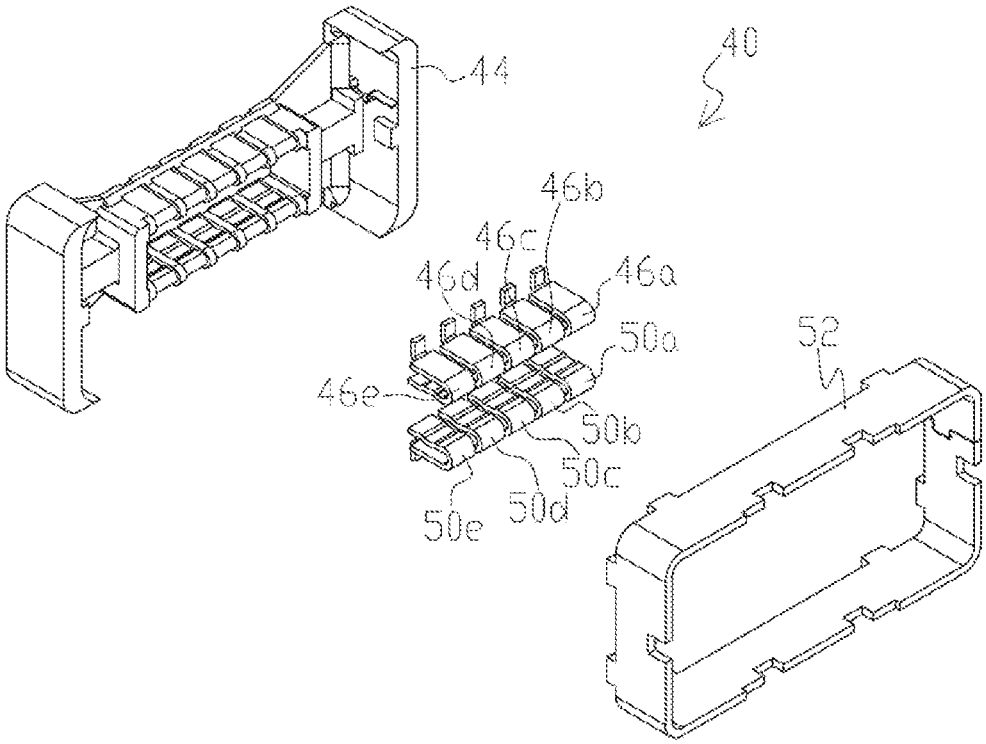
FIG. 8 is an exploded view of the plug connector according to another embodiment illustrating the configuration thereof.
Figure 9A:
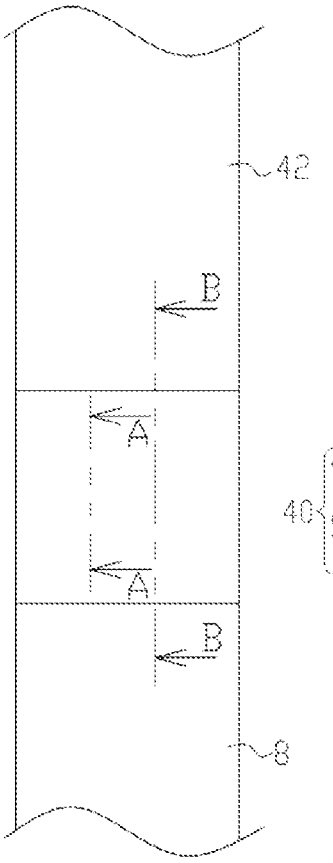
FIGS. 9A to 9C are diagrams illustrating a state in which the receptacle connector and the plug connector according to another embodiment are fitted.
Figures 9B, 9C:
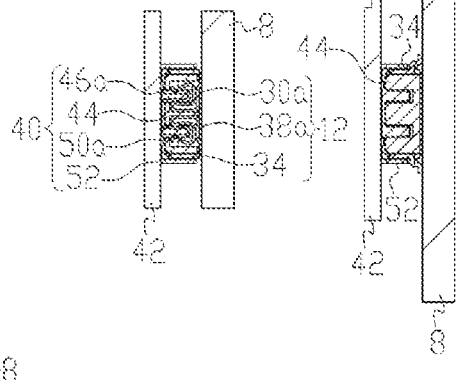

For example, if a wiring material to be connected to plug connector 10 is only an electrical wire, plug connector 10 is a board-to electrical wire connector. Instead of plug connector 10, plug connector 40 shown in FIG. 7 may be used. FIG. 7 is a perspective view of plug connector 40 illustrating the configuration thereof. FIG. 8 is an exploded view of plug connector 40 illustrating the configuration thereof. FIG. 9A is a front view of receptacle connector 12 and plug connector 40 in fitted state. FIG. 9B is a cross-sectional view taken along A-A of FIG. 9A. FIG. 9C is a cross-sectional view taken along B-B of FIG. 9A. Plug connector 40 is a connector that can be fitted to receptacle connector 12 and is mounted on flexible printed board 42. If a rigid board is used instead of flexible printed board 42, plug connector 40 is a board-to-board connector.

Plug connector 40 is mounted on flexible printed board 42 and includes housing 44, ten contacts 46*a* to 46*e* and 50*a* to 50*e*, and shell 52. flexible printed board 42 is disposed at a hinge of personal computer. Contacts 46*a* to 46*e* and 50*a* to 50*e* are built in housing 44. When receptacle connector 12 and plug connector 40 are fitted, contacts 46*a* to 46*e* are electrically connected to mating contacts 30*a* to 30*e* of receptacle connector 12, respectively. Likewise, when receptacle connector 12 and plug connector 40 are fitted, contacts 50*a* to 50*e* are electrically connected to mating contacts 38*a* to 38*e* of receptacle connector 12, respectively. When receptacle connector 12 and plug connector 40 are fitted, shell 52 mounted on the surface of flexible printed board 42 is electrically connected to shell 34 mounted on the surface of antenna module board 8. In other words, flexible printed board 42 is connected to the gland of antenna module board 8 via shell 52 and shell 34.

Contacts 46*a* to 46*e* are arranged in order from the −Y direction side. Contacts 50*a* to 50*e* are arranged in order from the −Y direction side. The array of contacts 46*a* to 46*e* and the array of contacts 50*a* to 50*e* are disposed in parallel in the X direction. The contact portions of contacts 46*a* to 46*e* to be connected to mating contacts 30*a* to 30*e* and the contact portions of contacts 50*a* to 50*e* to be connected to mating contacts 38*a* to 38*e* face each other.

Figure 10:
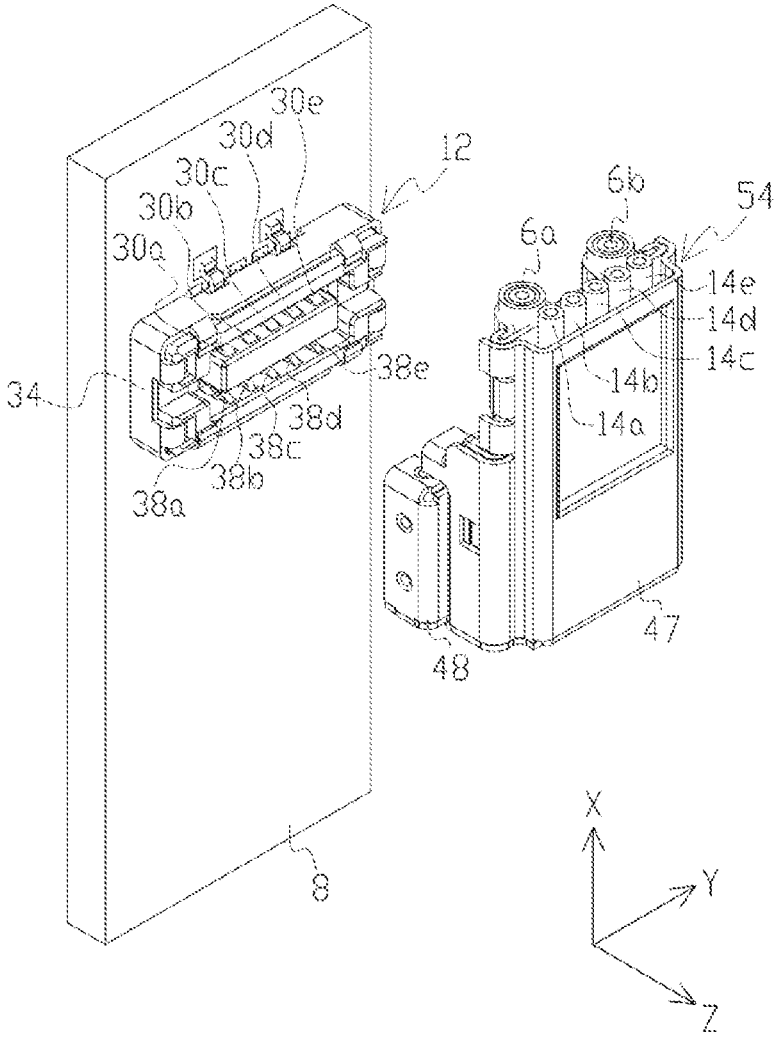
FIG. 10 is a perspective view of a receptacle connector and a plug connector according to another embodiment illustrating the configuration thereof.
Figure 11:
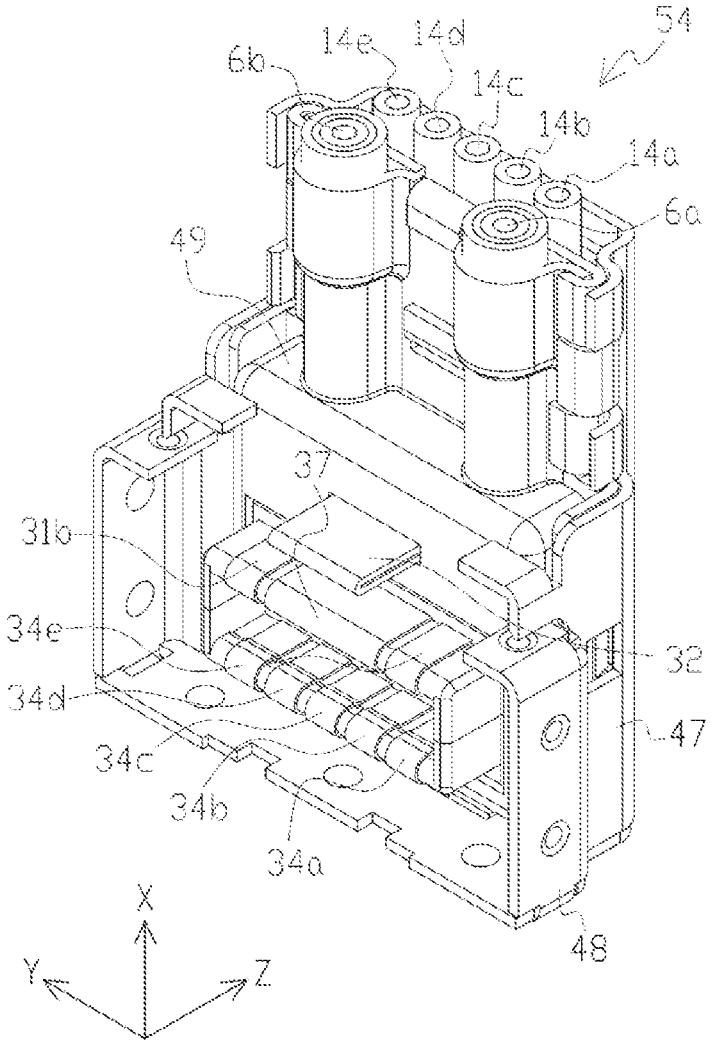
FIG. 11 is a perspective view of the plug connector according to another embodiment illustrating the configuration thereof.
Figure 12:
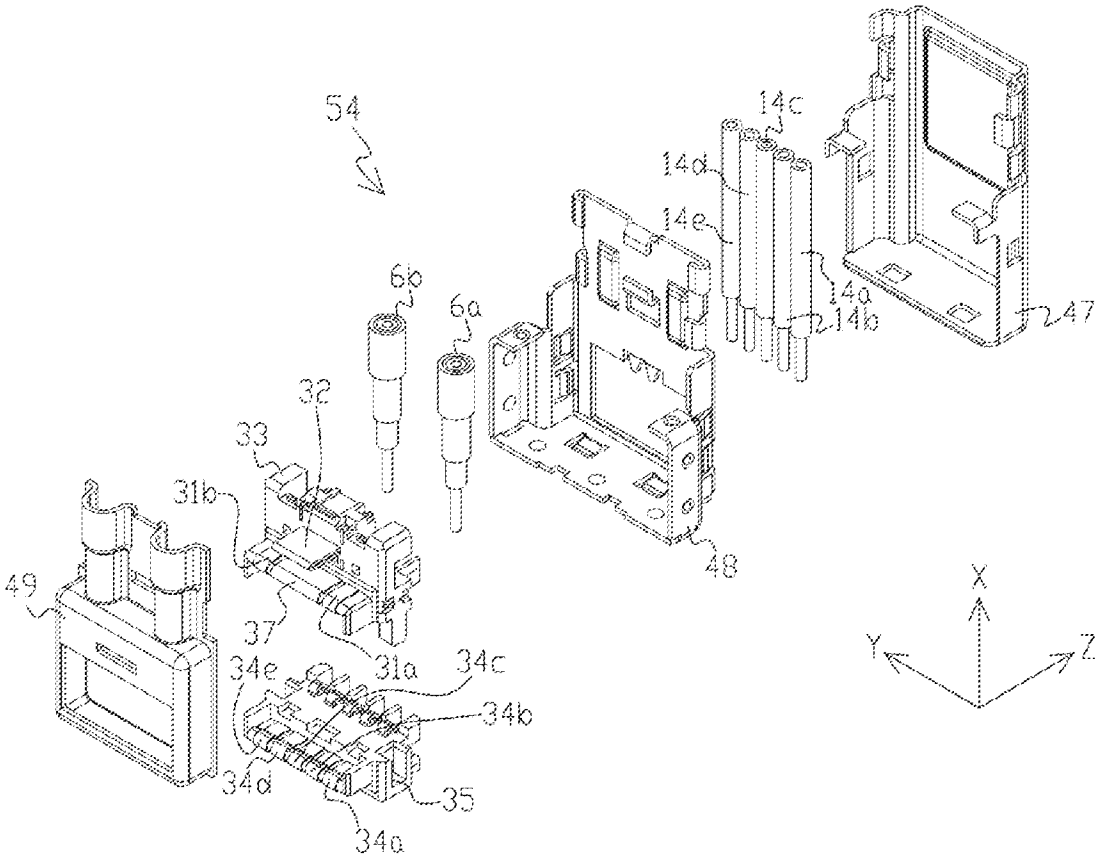
FIG. 12 is an exploded view of the plug connector according to another embodiment illustrating the configuration thereof.
Figure 13A:
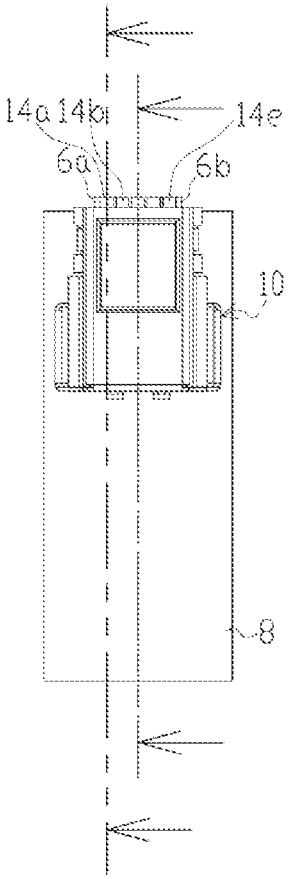
FIGS. 13A to 13C are diagrams illustrating a state in which the receptacle connector and the plug connector according to another embodiment are fitted.
Figure 13B:
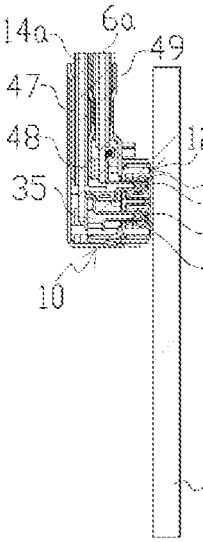
Figure 13C:
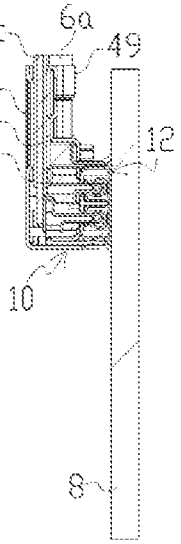

Instead of plug connector 10 according to Embodiment 1, a plug connector (electrical wire+coaxial cable complex connector) 54 shown in FIGS. 10 to 13C may be provided. FIG. 10 is a perspective view of receptacle connector 12 and plug connector 54 not fitted to each other. FIG. 11 is a perspective view of plug connector 54 illustrating the configuration thereof. FIG. 12 is an exploded view of plug connector 54 illustrating the configuration thereof. FIG. 13A is a front view of receptacle connector 12 and plug connector 54 in fitted state. FIG. 13B is a cross-sectional view taken along line A-A of FIG. 13A. FIG. 13C is a cross-sectional view taken along B-B of FIG. 13A. In FIGS. 10 to 13C, only the ends of coaxial cables 6*a* and 6*b* and electrical wires 14*a* to 14*e* are illustrated for the convenience of description of the configuration of plug connector 54. The same configurations as those of plug connector 10 are given the same reference signs, and descriptions thereof will be omitted.

Plug connector 54 includes first contacts 31*a* and 31*b*, gland fitting 32, housing 33, upper shell 47, middle shell 48, under shell 49, five third contacts 34*a* to 34*e*, and housing 35. First contacts 31*a* and 31*b* are conductors, such as metal, built in housing 33, and each include a core-wire connecting portion that electrically connects to corresponding one of the core wires of coaxial cables 6*a* and 6*b* and a first contact portion that is electrically connected to corresponding one of mating contacts 30*a* and 30*e* of receptacle connector 12.

Gland fitting 32 is a conductor, such as metal, which is built in housing 65 and connects to middle shell 48. Gland fitting 32 has second contact portion 37 to be electrically connected to mating contacts 30*b* to 30*d* of receptacle connector 12.

Upper shell 47 is a conductor, such as metal, and electrically connects to the external shields of electrical wires 14*a* to 14*e*. Middle shell 48 and under shell 49 are conductors, such as metal, and electrically connect to external shields 36*a* and 36*b* of coaxial cables 6*a* and 6*b*. Middle shell 48, under shell 49, and second contact portion 37 function as second contacts to be connected to the gland of antenna module board 8 via mating contacts 38*b* to 38*d*.

Upper shell 47 and middle shell 48 connect to each other. Middle shell 48 and under shell 49 connect to each other. Middle shell 48 is electrically connected to shell 34 of receptacle connector 12. Accordingly, external shields 36*a* and 36*b* of coaxial cables 6*a* and 6*b* are connected to the gland of antenna module board 8 via gland fitting 32, upper shell 47, middle shell 48, under shell 49, and shell 34 of receptacle connector 12.

Third contacts 34*a* to 34*e* are conductors, such as metal, which are built in housing 35. Third contacts 34*a* to 34*e* have, at one end, electrical-wire connecting portions that electrically connect to electrical wires 14*a* to 14*e*, respectively. Third contacts 34*a* to 34*e* have, at the other end, third contact portions to be electrically connected to mating contacts 38*a* to 38*e* of receptacle contact 12. The direction in which coaxial cables 6*a* and 6*b* and electrical wires 14*a* to 14*e* are inserted in plug connector 54 is the −X direction, which is a direction perpendicular to the fitting direction (Z direction) in which plug connector 54 and receptacle connector 12 are fitted or a direction along the perpendicular direction. Plug connector 54 can enhance processability and mass production efficiency.

Next, a wiring structure according to Embodiment 2 of the present invention will be described with reference to the drawings. In the wiring structure according to Embodiment 2, the configuration other than that of plug connector 10 is the same as the configuration of the wiring structure according to Embodiment 1 shown in FIG. 1. The wiring structure according to Embodiment 2 includes plug connector 55 (see FIG. 14) instead of plug connector 10 according to Embodiment 1. The same configurations as those of the wiring structure according to Embodiment 1 are given the same reference signs, and descriptions thereof will be omitted.

Figure 14:
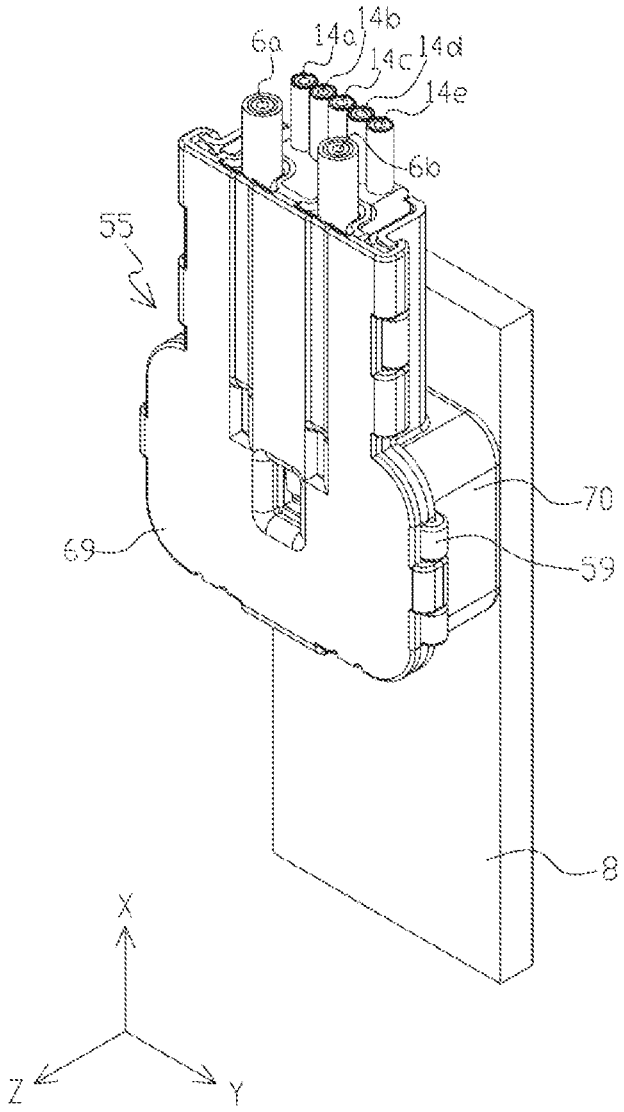
FIG. 14 is a perspective view of a receptacle connector mounted on an antenna module board and a plug connector fitted to the receptacle connector according to Embodiment 2.
Figure 15:
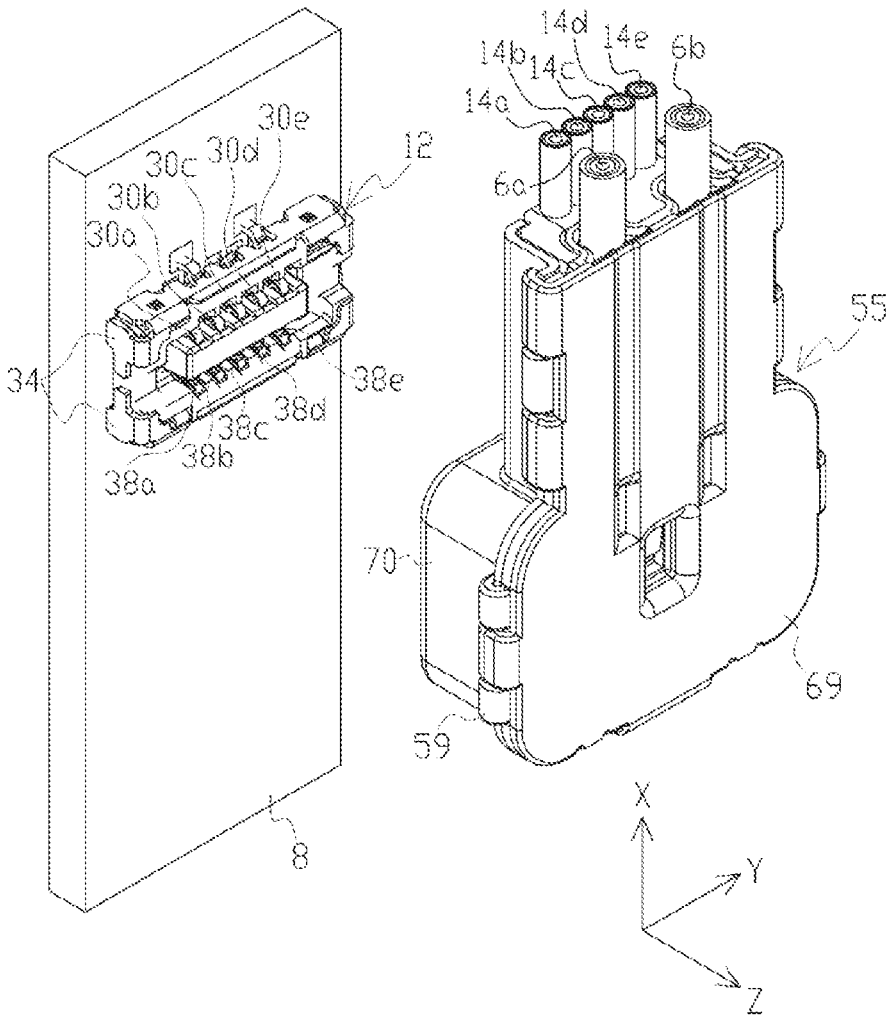
FIG. 15 is a perspective view of the receptacle connector and the plug connector according to Embodiment 2 illustrating the configuration thereof.
Figure 16:
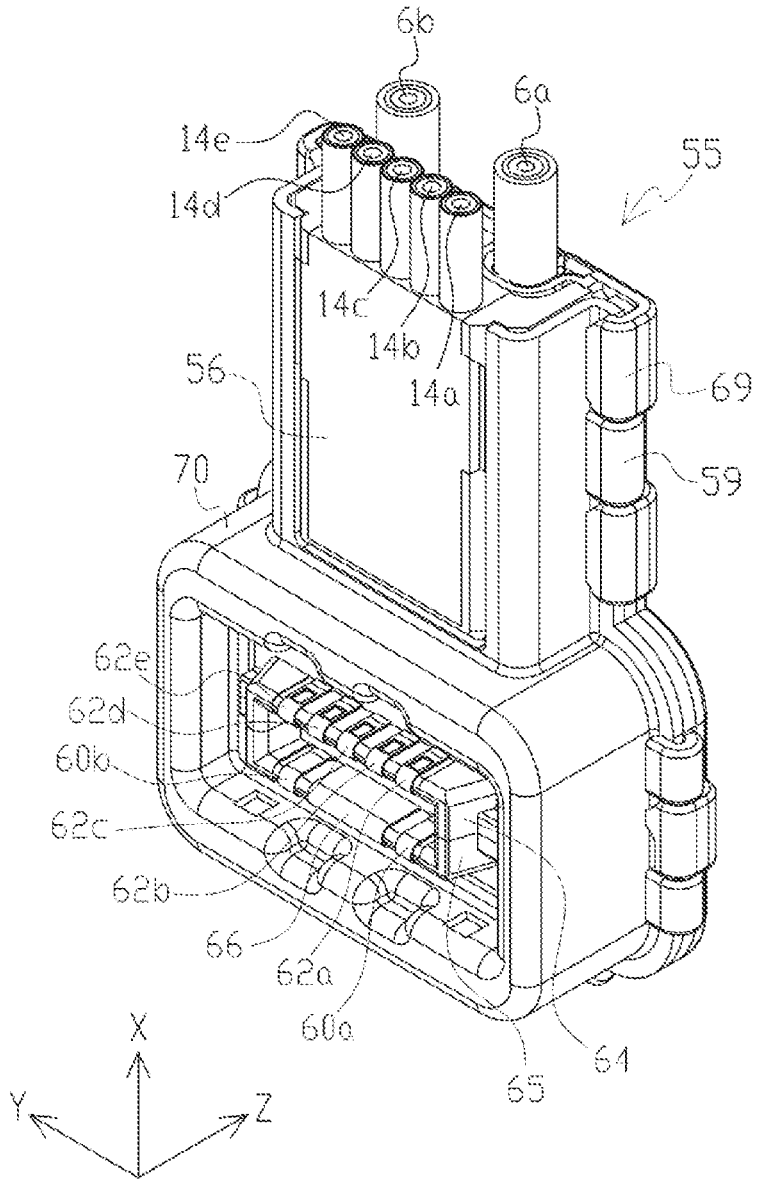
FIG. 16 is a perspective view of the plug connector according to Embodiment 2 illustrating the configuration thereof.
Figure 17:
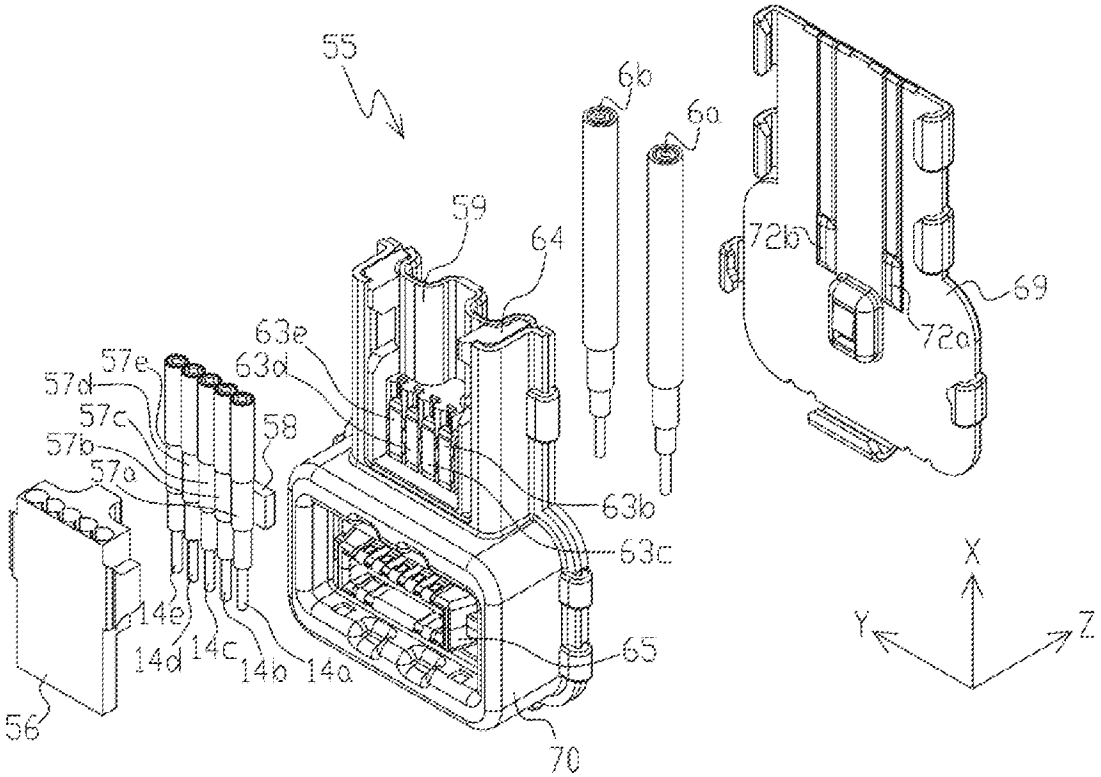
FIG. 17 is an exploded view of the plug connector according to Embodiment 2 illustrating the configuration thereof.
Figure 18:
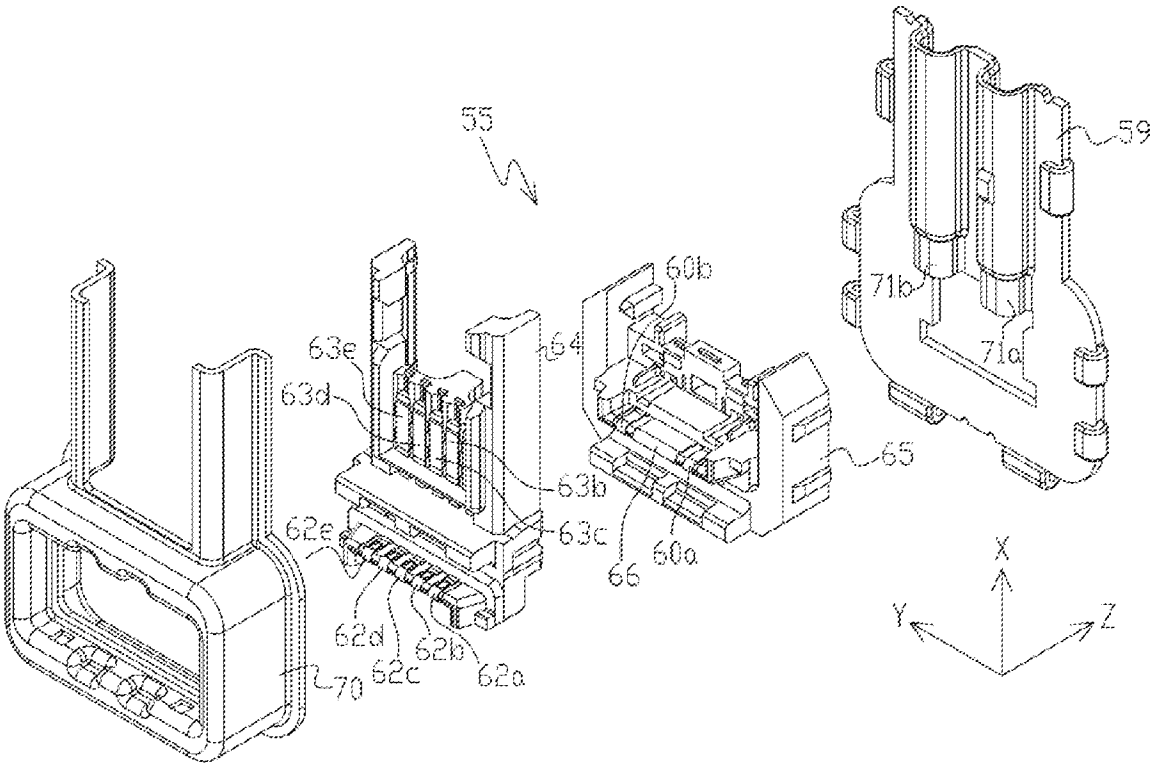
FIG. 18 is an exploded view of the plug connector according to Embodiment 2 illustrating the configuration thereof.
Figure 19A:
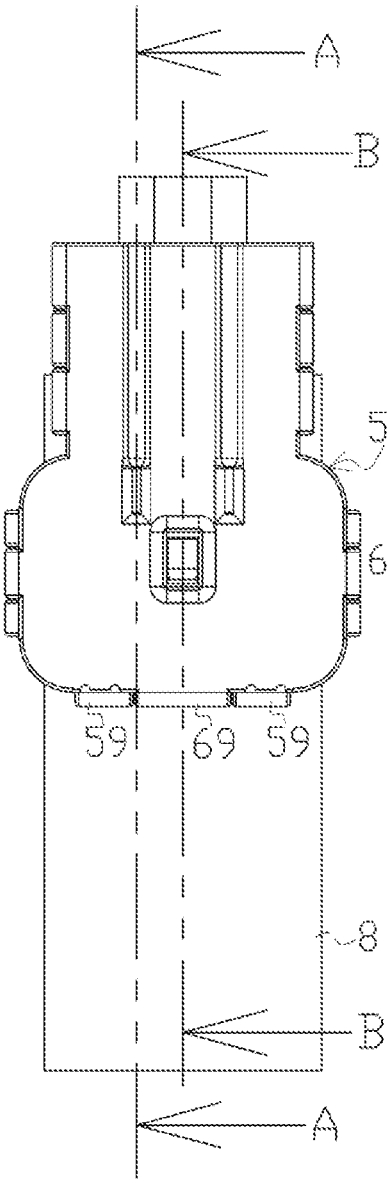
FIGS. 19A to 19C are diagrams illustrating a state in which the receptacle connector and the plug connector according to Embodiment 2 are fitted.
Figure 19B:
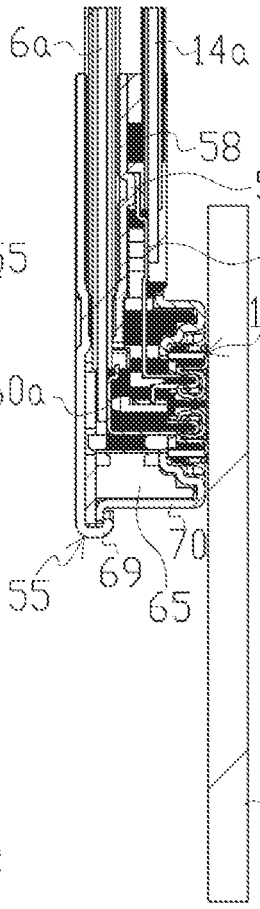
Figure 19C:
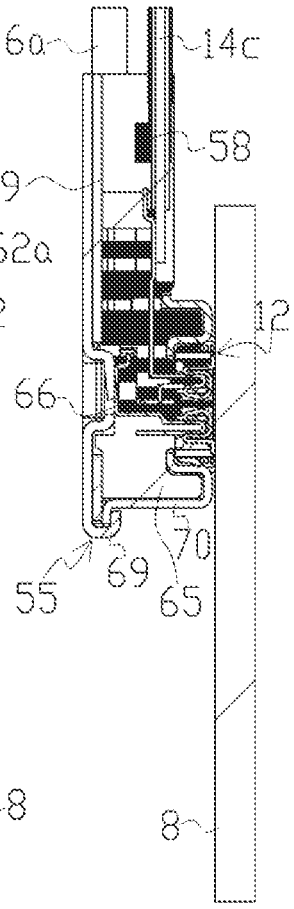

FIG. 14 is a perspective view of receptacle connector 12 and plug connector 55 in fitted state. FIG. 15 is a perspective view of receptacle connector 12 and plug connector 55 not fitted to each other. FIG. 16 is a perspective view of plug connector 55 illustrating the configuration thereof. FIGS. 17 and 18 are exploded views of plug connector 55 illustrating the configuration thereof. FIG. 19A is a front view of receptacle connector 12 and plug connector 55 in fitted state. FIG. 19B is a cross-sectional view taken along line A-A of FIG. 19A. FIG. 19C is a cross-sectional view taken along line B-B of FIG. 19A. In FIGS. 14 to 19C, only the ends of coaxial cables 6*a* and 6*b* and electrical wires 14*a* to 14*e* are illustrated for the convenience of description of the configuration of plug connector 55.

Figure 20:
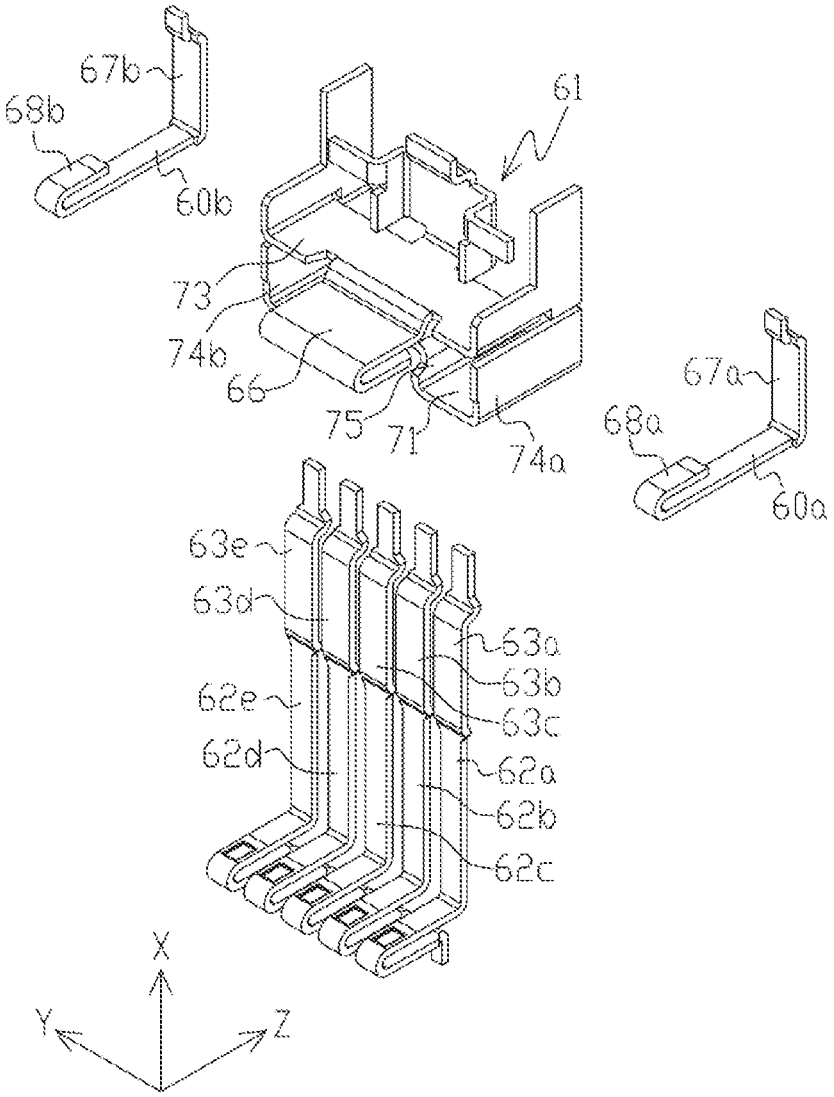
FIG. 20 is a diagram illustrating the configuration of components constituting the plug connector according to Embodiment 2.

As shown in FIGS. 14 to 19C, plug connector 55 includes two first contacts 60*a* and 60*b*, gland fitting 61, housing 65, upper shell 69, middle shell 59, under shell 70, five third contacts 62*a* to 62*e*, and housing 64. FIG. 20 is a diagram illustrating the configuration of two first contacts 60*a* and 60*b*, gland fitting 61, and five third contacts 62*a* to 62*e*.

First contacts 60*a* and 60*b* are conductors, such as metal, which are built in housing 65. First contact 60*a* has, at one end 67*a*, a core-wire connecting portion that electrically connects to the core wire of coaxial cable 6*a*. First contact 18*a* has, at the other end 68*a*, a first contact portion to be electrically connected to mating contact (first connection terminal) 38*a* of receptacle connector 12 when receptacle connector 12 and plug connector 55 are fitted. Likewise, first contact 60*b* has, at one end 67*b*, a core-wire connecting portion that electrically connects to the core wire of coaxial cable 6*b*, and first contact 60*b* has, at the other end 68*b*, a first contact portion to be electrically connected to mating contact (first connection terminal) 38*e* of receptacle connector 12 when receptacle connector 12 and plug connector 10 are fitted.

Gland fitting 61 is a conductor, such as metal, which is built in housing 65, which is an insulator, such as resin. Gland fitting 61 connects to upper shell 69, which is a conductor, such as metal. Upper shell 69 connects to middle shell 59, which is a conductor, such as metal, and to under shell 70, which is a conductor, such as metal. Upper shell 69 has shield connecting portions 72*a* and 72*b* that electrically connect to external shields 36*a* and 36*b* of coaxial cables 6*a* and 6*b*. Likewise, middle shell 59 has shield connecting portions 71*a* and 71*b* that electrically connect to external shields 36*a* and 36*b* of coaxial cables 6*a* and 6*b*.

Gland fitting 61 has a second contact portion 66 that is electrically connected to mating contacts (second connection terminals) 38*b* to 38*d* of receptacle connector 12 when receptacle connector 12 and plug connector 55 are fitted. Shield connecting portions 72*a* and 72*b* of upper shell 69, shield connecting portions 71*a* and 71*b* of middle shell 59, and second contact portion 66 of gland fitting 61 function as second contacts to be connected to gland of antenna module board 8 via mating contacts 38*b* to 38*d*.

Upper shell 69, middle shell 59, and under shell 70 connect to each other, as described above. When receptacle connector 12 and plug connector 55 are fitted, under shell 70 is electrically connected to shell 34 of receptacle connector 12. Accordingly, external shields 36*a* and 36*b* of coaxial cables 6*a* and 6*b* are connected to the gland of antenna module board 8 via gland fitting 61, upper shell 69, middle shell 59, under shell 70, and shell 34 of receptacle connector 12.

Gland fitting 61 includes first shielding plate 71 and a first shielding plate (not shown). First shielding plate 71 and the first shielding plate (not shown) each have a surface along a plane parallel to the Y-Z plane. First shielding plate 71 shields at least part (part or the whole) between first contact 60*a* and third contact 62*a*. first shielding plate (not shown) shields at least part (part or the whole) between first contact 60*b* and third contact 62*e*. First shielding plate 71 and the first shielding plate (not shown) are indirectly connected to the gland of antenna module board 8 via gland fitting 61, upper shell 69, middle shell 59, under shell 70, and shell 34 of receptacle connector 12.

Gland fitting 61 includes second shielding plate 73. Second shielding plate 73 has a surface along a plane parallel to the Y-Z plane and is disposed on the +X direction side of first contacts 60*a* and 60*b*. In other words, second shielding plate 73 shields at least part (part or the whole) of first contacts 60*a* and 60*b* on the outside (+X direction) of first contacts 60*a* and 60*b* and third contacts 62*a* to 62*e*. Second shielding plate 73 is indirectly connected to the gland of antenna module board 8 via gland fitting 61, upper shell 69, middle shell 59, under shell 70, and shell 34 of receptacle connector 12.

Gland fitting 61 includes third shielding plates 74*a*, 74*b*, and 75 and a third shielding plate (not shown). Third shielding plate 74*a* has a surface along a plane parallel to the Z-X plane and is disposed on the −Y direction side of first contact 60*a*. In other words, third shielding plate 74*a* shields at least part (part or the whole) of first contact 60*a* on one side (−Y direction side) on which first contacts 60*a* and 60*b* and third contacts 62*a* to 62*e* are disposed.

Third shielding plate 74*b* has a surface along a plane parallel to the Z-X plane and is disposed on the +Y direction side of first contact 60*b*. In other words, third shielding plate 74*b* shields at least part (part or the whole) of first contact 60*b* on one side (+Y direction side) on which first contacts 60*a* and 60*b* and third contacts 62*a* to 62*e* are disposed.

Third shielding plate 75 is disposed on the +Y direction side of first contact 60*a*. In other words, third shielding plate 75 shields at least part (part or the whole) of first contact 60*a* on one side (+Y direction) on which first contacts 60*a* and 60*b* and third contacts 62*a* to 62*e* are disposed. The third shielding plate (not shown) is disposed on the −Y direction side of first contact 60*b*. In other words, the third shielding plate (not shown) shields at least part (part or the whole) of first contact 60*b* on one side (−Y direction side) on which first contacts 60*a* and 60*b* and third contacts 62*a* to 62*e* are disposed. Third shielding plates 74*a*, 74*b*, and 75 and the third shielding plate (not shown) are indirectly connected to the gland of antenna module board 8 via gland fitting 61, upper shell 69, middle shell 59, under shell 70, and shell 34 of receptacle connector 12. Second contact portion 66 serving as the second contact functions also as a third shielding plate.

First contact 60*a* is enclosed in all directions by first shielding plate 71, second shielding plate 73, third shielding plate 74*a*, third shielding plate 75, and second contact portion 66, which are indirectly connected to the gland of antenna module board 8. This configuration allows for appropriately transmitting high-speed signals, with the impedance of first contact 60*a* and the impedance of coaxial cable 6*a* matched. Likewise, second contact 60*b* is enclosed in all directions by first shielding plate 71, second shielding plate 73, third shielding plate 74*a*, third shielding plate 75, and second contact portion 66, which are indirectly connected to the gland of antenna module board 8. This configuration allows for appropriately transmitting high-speed signals, with the impedance of first contact 60*b* and the impedance of coaxial cable 6*b* matched.

First shielding plate 71, second shielding plate 73, third shielding plate 74*a*, third shielding plate 75 may directly connect to external shields 36*a* and 36*b* or alternatively, first shielding plate 71, second shielding plate 73, third shielding plate 74*a*, third shielding plate 75 may be directly connected to the gland of antenna module board 8.

As shown in FIGS. 16 and 17, housing 56 houses electrical wires 14*a* to 14*e*. Gland plate 58 electrically connects to shields 57*a* to 57*e* that shields electrical wires 14*a* to 14*e*, respectively.

Third contacts 62*a* to 62*e* are conductors, such as metal, which are built in housing 64. Third contacts 62*a* to 62*e* has, at one end, electrical-wire connecting portions 63*a* to 63*e* which electrically connect to electrical wires 14*a* to 14*e*, respectively. Third contacts 62*a* to 62*e* have, at the other end, third contact portions (not shown) to be electrically connected to mating contacts (third connection terminals) 30*a* to 30*e* of receptacle contact 12.

The direction in which coaxial cables 6*a* and 6*b* and electrical wires 14*a* to 14*e* are inserted in plug connector 55 is the −X direction, which is a direction perpendicular to the fitting direction (Z direction) in which plug connector 55 and receptacle connector 12 are fitted or a direction along the perpendicular direction. Electrical wires 14*a* to 14*e* are inserted closer to the fitting side on which plug connector 55 is fitted to receptacle connector 12 than coaxial cables 6*a* and 6*b*, in other words, adjacent to antenna module board 8 (−Z direction side).

Figure 21:
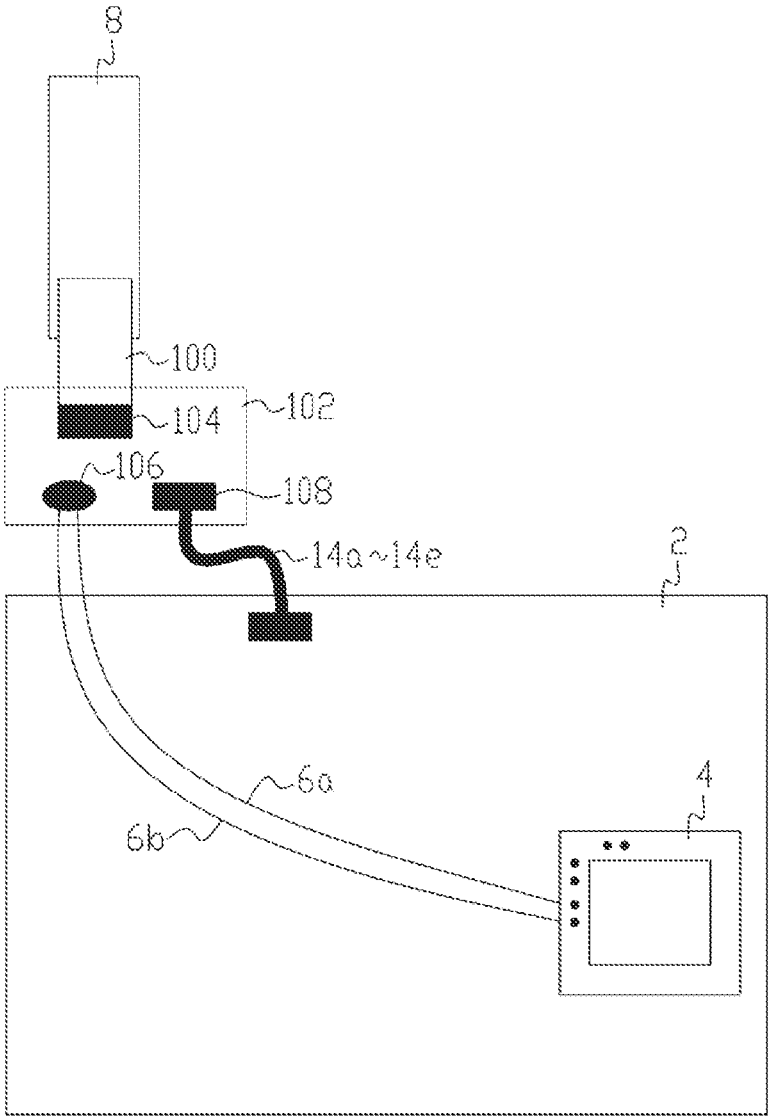
FIG. 21 is a diagram illustrating, in outline, the configuration of connection between an antenna module board and a circuit board according to a comparative example.

FIG. 21 is a diagram illustrating, in outline, the configuration of connection between antenna module board 8 for a smartphone and circuit board 2 of a personal computer according to a comparative example. This is one of assumed methods for connecting antenna module board 8 for a smartphone and circuit board 2 of a personal computer. As shown in FIG. 21, receptacle connector 12 of antenna module board 8 is connected to a plug connector (not shown) mounted on short flexible printed board 100. Short flexible printed board 100 is connected to printed board 102 with board-to-board connector 104. Coaxial cables 6*a* and 6*b* are connected to printed board 102 with board-to-electrical-wire connector 106. Electrical wires 14*a* to 14*e* are connected to printed board 102 with board-to-electrical-wire connector 108. In comparison between FIG. 1 and FIG. 21, plug connector 10 (as well as plug connector 54) is a connector having all of the functions of the connector (not shown) mounted on short flexible printed board 100 shown in FIG. 21, short flexible printed board 100, printed board 102, board-to-board connector 104, board-to-electrical-wire connector 106, and board-to-electrical-wire connector 108, which are combined into one. In other words, using plug connectors 10, 54, and 55 allows for not only simplification of the wiring but also low cost.

Although the above embodiments have been described using an example including two coaxial cables, one or three or more coaxial cables may be included. Likewise, although the above embodiments have been described using an example including five electrical wires, four or less or six or more electrical wires may be included. Although the above embodiments have been described using an example including coaxial cables and electrical wires, only one of them may be included.

Although the above embodiments have been described using an example in which a second contact (gland contact) is disposed between first contacts (signal contacts), the order of arrangement of the first contacts and the second contact is not limited. For example, two first contacts and three second contacts may be arranged so that the first contacts are disposed between the second contacts.

REFERENCE SIGNS LIST

1 Wiring structure
2 Circuit board
4 Expansion card
6*a*, 6*b* Coaxial cable
8 Antenna module board
10, 40, 54, 55 Plug connector
12 Receptacle connector
14*a* to 14*e* Electrical wire
16*a*, 16*b*, 24, 28, 33, 35, 44, 64, 65 Housing
18*a*, 18*b*, 31*a*, 31*b*, 60*a*, 60*b* First contact
20, 37, 66 Second contact portion
21, 23*a*, 23*b* Shielding plate
48*a* to 48*c* Second contact
22, 32, 61 Gland fitting
26*a* to 26*e*, 34*a* to 34*e*, 62*a* to 62*e* Third contact
30*a* to 30*e*, 38*a* to 38*e* Mating contact
34, 52 Shell
36*a*, 36*b* External shield
42 Flexible Printed board
46*a* to 46*e*, 50*a* to 50*e* Contact
47, 69 Upper shell
48, 59 Middle shell
49, 70 Under shell
71 First shielding plate
72 Second shielding plate
74*a*, 74*b*, 75 Third shielding plate

What is claimed is:

1. A wire-to-board connector comprising:

a plurality of first contacts connected respectively to core wires of a plurality of coaxial cables;

a second contact connected to an external shield of the plurality of coaxial cables;

a plurality of third contacts connected to a plurality of electrical wires different from the plurality of coaxial cables; and a housing that houses the first to the third contacts and houses the plurality of coaxial cables and the plurality of electrical wires connected mechanically to the first to the third contacts, wherein the plurality of coaxial cables and the plurality of electrical wires are connected electrically to a circuit board by vertical fitting to a mating connector mounted on the circuit board, the plurality of first contacts each include a first contact surface to be in contact with a corresponding first mating contact in the mating connector, the second contact includes a second contact surface to be in contact with a second mating contact of the mating connector, the plurality of third contacts each include a third contact surface to be in contact with a corresponding third mating contact in the mating connector, the plurality of first contact surfaces and the second contact surface are arranged in a row on a first virtual plane along a fitting direction, and the plurality of third contact surfaces are arranged in a row on a second virtual plane facing the first virtual plane, the plurality of third contact surfaces being arranged parallel to a direction in which the plurality of first contact surfaces and the second contact surface are arranged.

2. The connector according to claim 1, wherein p1 the mating connector is fittable to a board-to-board connector mounted on a flexible printed board connected to a main board of a smartphone, and the circuit board is an antenna module board.

3. The connector according to claim 1, wherein the second contact surface is disposed between two first contact surfaces adjacent to each other among the plurality of the first contact surfaces.

4. The connector according to claim 1, wherein the second contact includes a relay portion connecting between a second contact portion including the second contact surface and a shield connection portion including a shield connection surface to be in contact with the external shield, and the relay portion is formed by one sheet of a board material.

5. The connector according to claim 1, wherein the second contact includes a shielding portion interposed between the plurality of first contacts and the plurality of third contacts.

6. The connector according to claim 5, wherein the shielding portion surrounds the plurality of first contacts.

7. The connector according to claim 1, wherein the housing houses the plurality of coaxial cables and the plurality of electrical wires with the coaxial cables and the electrical wires extended in a direction perpendicular to the fitting direction.

8. The connector according to claim 7, wherein the housing houses the plurality of coaxial cables arranged in a row and houses the plurality of electrical wires arranged in a row in a same direction as a direction in which the plurality of coaxial cables are arranged; and the plurality of coaxial cables and the plurality of electrical wires overlap each other in the fitting direction.

9. A wire-to-board connector comprising:

a plurality of first contacts connected respectively to core wires of a plurality of coaxial cables;

a second contact connected to an external shield of the plurality of coaxial cables;

a plurality of third contacts connected to a plurality of electrical wires different from the plurality of coaxial cables; and a housing that houses the first to the third contacts and houses the plurality of coaxial cables and the plurality of electrical wires connected mechanically to the first to the third contacts, wherein the plurality of coaxial cables and the plurality of electrical wires are connected electrically to a circuit board by vertical fitting to a mating connector mounted on the circuit board, the plurality of coaxial cables are housed while being arranged in a row and the plurality of electrical wires are housed while being arranged in a row in a same direction as a direction in which the plurality of coaxial cables are arranged, and the plurality of coaxial cables and the plurality of electrical wires extend in a direction perpendicular to a fitting direction and overlap each other in the fitting direction.

10. A wire-to-board connector comprising:

a plurality of first contacts connected respectively to core wires of a plurality of coaxial cables; and a second contact connected to an external shield of the plurality of coaxial cables, wherein the plurality of coaxial cables and the plurality of electrical wires are connected electrically to a circuit board by vertical fitting to a mating connector mounted on the circuit board, the plurality of first contacts each include a first contact portion to be in contact with a corresponding first mating contact in the mating connector, and the second contact includes:

a second contact portion to be in contact with a second mating contact of the mating connector;

a shield connection portion connected to the external shield; and a relay portion connecting between the second contact portion and the shield connection portion, and wherein the relay portion is formed by one sheet of a board material.

11. A wiring structure comprising:

a first board;

a second board that is an antenna module board;

a plurality of coaxial cables connected to the first board and used for transmission of a high frequency signal;

a plurality of electrical wires connected to the first board and used for a power supply system or a control system;

a first connector integrally attached to the plurality of coaxial cables and the plurality of electrical wires; and a second connector mounted on the second board, wherein the first board and the second board are electrically connected with each other by the first connector and the second connector fitted to each other.

12. The wiring structure according to claim 11, wherein the first connector includes:

a plurality of first contacts connected respectively to core wires of a plurality of coaxial cables;

a second contact connected to an external shield of the plurality of coaxial cables;

a plurality of third contacts connected to the plurality of electrical wires; and a housing that houses the first to the third contacts and houses the plurality of coaxial cables and the plurality of electrical wires connected mechanically to the first to the third contacts.

13. The wiring structure according to claim 11, wherein the second connector is fittable to a board-to-board connector mounted on a flexible printed board connected to a main board of a smartphone.

14. The wiring structure according to claim 13, wherein the first board is a main board of a communication device other than a smartphone.

15. The wiring structure according to claim 14, wherein the communication device includes a hinge, and the plurality of coaxial cables and the plurality of electrical wires are arranged so as to cross the hinge.

16. The wiring structure according to claim 14 further comprising a sub-board that is mounted on the main board, wherein the main board is connected to the plurality of coaxial cables via the sub- board.

17. An inter-board connection method comprising:

integrally attaching a plurality of coaxial cables and a plurality of electrical wires to a first wire-to-board connector, the plurality of coaxial cables being connected to a first board and used for transmission of a high frequency signal, the plurality of electrical wires being connected to the first board and used for a power supply system or a control system;

preparing a second board that is an antenna module board on which a second connector is mounted;

electrically connecting between the first board and the second board by fitting the first connector and the second connector to each other.

18. The inter-board connection method according to claim 17, wherein the second connector is fittable to a board-to-board connector mounted on a flexible printed board connected to a main board of a smartphone.

* * * * *